United States Patent [19]

Sasada et al.

[11] Patent Number: 4,848,293

[45] Date of Patent: Jul. 18, 1989

[54] OIL PAN FOR VEHICLE ENGINE

[75] Inventors: Takashi Sasada, Higashihiroshima; Syuzi Okazaki, Hiroshima, both of Japan

[73] Assignee: Mazda Motor Corporation, Hiroshima, Japan

[21] Appl. No.: 185,630

[22] Filed: Apr. 25, 1988

[30] Foreign Application Priority Data

Apr. 24, 1987 [JP] Japan ..... 62-63319[U]

[51] Int. Cl.[4] ..... F01M 11/00

[52] U.S. Cl. ..... 123/195 C; 184/106

[58] Field of Search ..... 123/195 C, 198 E; 184/6.5, 106

[56] References Cited

U.S. PATENT DOCUMENTS

| | | | |
|---|---|---|---|
| 4,395,982 | 8/1983 | Möller | 123/195 C |
| 4,457,274 | 7/1984 | Gottlob | 123/195 C |
| 4,669,432 | 6/1987 | Harada | 123/195 C |
| 4,683,850 | 8/1987 | Bauder | 123/195 C |
| 4,770,276 | 9/1988 | Takubo | 123/195 C |

FOREIGN PATENT DOCUMENTS

| | | | |
|---|---|---|---|
| 1102169 | 10/1955 | France | 184/106 |
| 0581948 | 9/1958 | Italy | 184/106 |

*Primary Examiner*—Willis R. Wolfe

*Attorney, Agent, or Firm*—Fleit, Jacobson, Cohn, Price, Helman & Stern

[57] ABSTRACT

An oil pan for a vehicle engine is cast to have shallow and deepened bottom oil pan sections and an integral fitting flange to which a transmission case is attached. The fitting flange is formed with bosses for receiving bolts to tightly attach the oil pan to an engine block of the vehicle engine. First or outer reinforcing ribs extend along the center line of the bosses. Second or back reinforcing ribs are arranged correspondingly to the outer reinforcing ribs. Bolts pass through the bosses and tighten the oil pan to the bottom of the cylinder block of the vehicle engine.

18 Claims, 4 Drawing Sheets

OIL PAN FOR VEHICLE ENGINE

FIELD OF THE INVENTION

The present invention relates to an oil pan for a vehicle engine.

BACKGROUND OF THE INVENTION

Recently, oil pans are generally made of thin light alloy cast to shape for the purpose of lightening an engine with its associated elements. One such oil pan is disclosed in, for example, Japanese Utility Model Unexamined Publication No. 61-173,754 entitled "Oil Pan", laid open Oct. 29, 1986.

Such an oil pan, which is attached to the bottom of an engine block with cap screws or bolts at several points, has a circular arcuate flange integrally formed on one side surface thereof to which a transmission case is attached with cap screws or bolts. In such an oil pan, for fixing the oil pan having the circular arcuate flange to the bottom of the engine block with cap screws or bolts, the circular arcuate flange is formed with bosses through which the bolts are screwed in the bottom of the engine block. Because the boss is formed spaced apart from the fitting surface of the oil pan to the engine block, the boss is weak in rigidity and is liable to be deformed when the bolts are tightly screwed in the bottom of the engine block. This makes it hard to tightly fasten the oil pan to the engine block. Furthermore, because the circular arcuate flange has an downward extension below the bottom of the oil pan, the flange is also liable to be deformed by vibrations of a transmission case attached thereto.

OBJECT OF THE INVENTION

It is, therefore, an object of the present invention to provide an oil pan used on a vehicle engine which makes it possible not only to have a structural rigidity against vibrations of a transmission case attached thereto but to be fastened tightly to an engine block with bolts.

SUMMARY OF THE INVENTION

In brief, the above and other objects of the present invention are accomplished by providing a cast oil pan integrally formed with a fitting flange to which a transmission case is attached, the fitting flange being integrally formed with bosses for fastening bolts and first or outer ribs extending along the bosses on the front or outer surface thereof and with second or inner ribs extending correspondingly to the first ribs on the back or inner surface thereof.

According to a feature of the present invention, the outer and inner ribs act as reinforcing members for increasing the structural strength or rigidity of the fitting flange and bosses when the oil pan is tightly attached to the engine block with bolts.

BRIEF DESCRIPTION OF THE DRAWINGS

The above and other objects and features of the present invention will be apparent from the following description taken in conjunction with a preferred embodiment thereof with reference to the accompanying drawings in which.

DETAILED DESCRIPTION OF THE INVENTION

Figure 1:
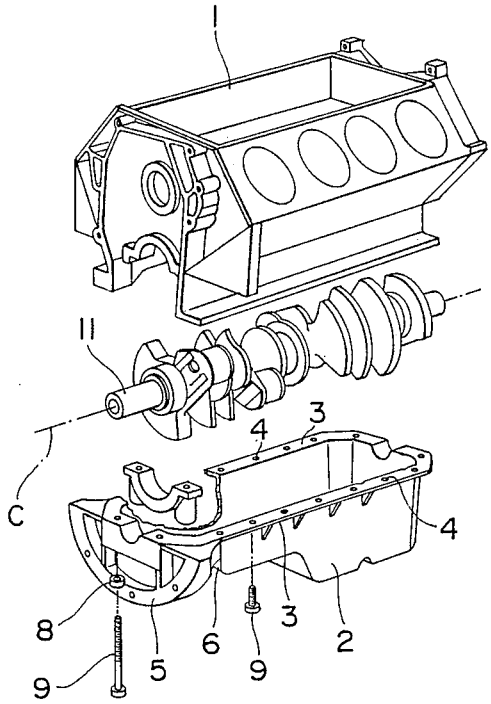
FIG. 1 is an perspective view illustrating in general an oil pan, a crankshaft and an engine block to be assembled together.
Figure 2:
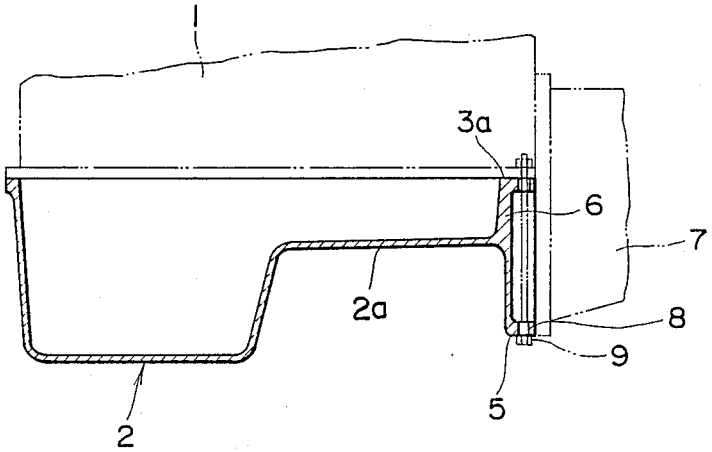
FIG. 2 is a cross sectional view showing a prior art oil pan.

Before describing the present invention in detail, reference is made to FIGS. 1 and 2 for the purpose of providing a brief description of a conventional oil pan. This will enhance an understanding of the constructional features of the present invention. As shown in FIGS. 1 and 2, an oil pan 2 is bolted to the bottom of a cylinder block 1 of a vehicle engine through an oil pan gasket (not shown). Within the oil pan is located a crankshaft and output shaft 11 having an axis C. For bolting, the oil pan 2 is formed with side fitting flanges 3 which are formed therein with a plurality of holes 4 at regular intervals. The oil pan 2 is also formed with a semi-circular fitting flange 5 on its front wall 6 to which a transmission case 7 is bolted. The semi-circular fitting flange 5 is provided with bosses 8 for bolts which are spaced apart from the top surfaces 3*a* of the side fitting flanges 3 that function as fitting surfaces to the bottom of the cylinder block 1 and are used to put therein bolts 9 having a long shank which are screwed in the bottom of the cylinder block 1. Therefore, each boss 8 is not so rigid when the oil pan 2 is fastened and attached to the cylinder block 1. The location of such bosses 8 weakens the bosses 8 themselves in rigidity and, therefore, it is relatively hard to tightly fasten the oil pan 2 to the cylinder block 1 with bolts.

Due to the constructional feature of the oil pan 2 having the semi-circular fitting flange 5 partly extending downwardly beyond the bottom 2*a* thereof, the oil pan 2 is apt to be deformed by vibrations caused in the transmission case 7.

Figure 3:
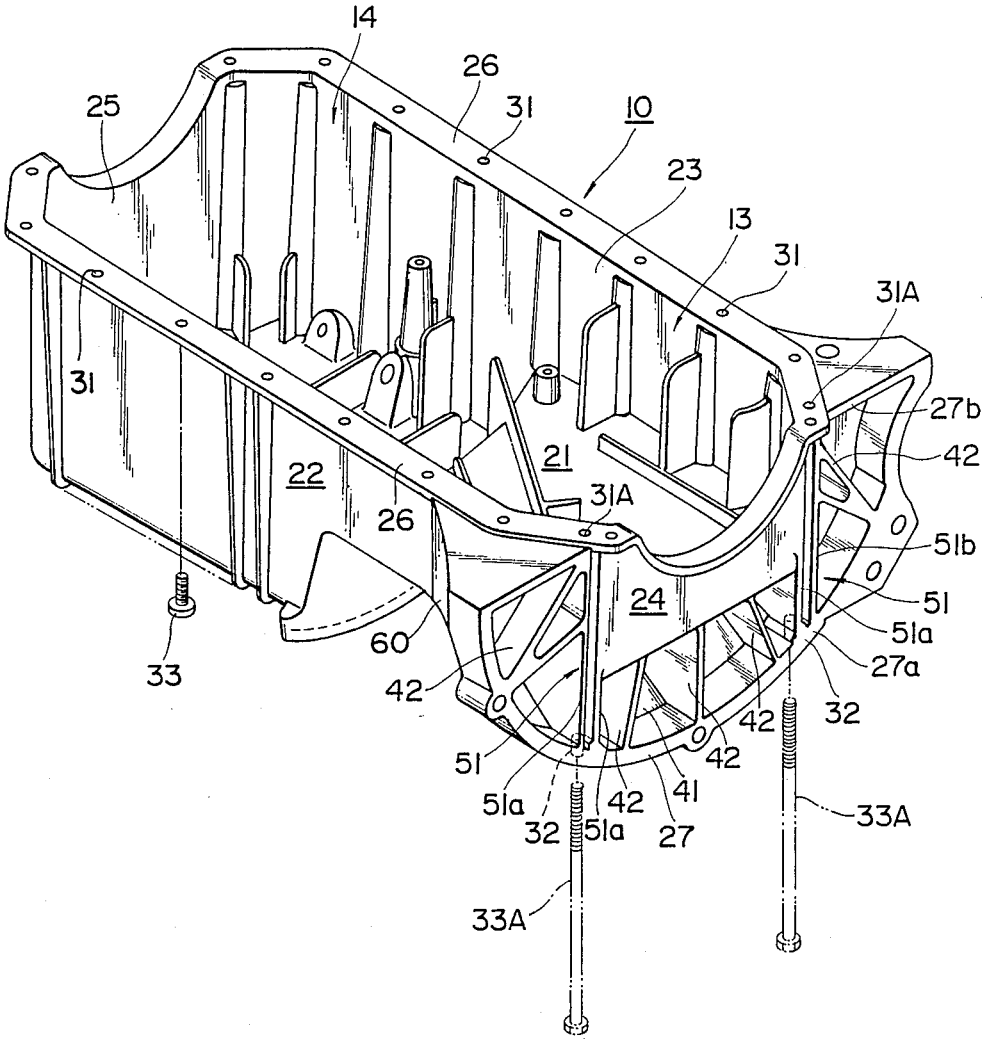
FIG. 3 is a perspective view of an oil pan according to the present invention.
Figure 4:
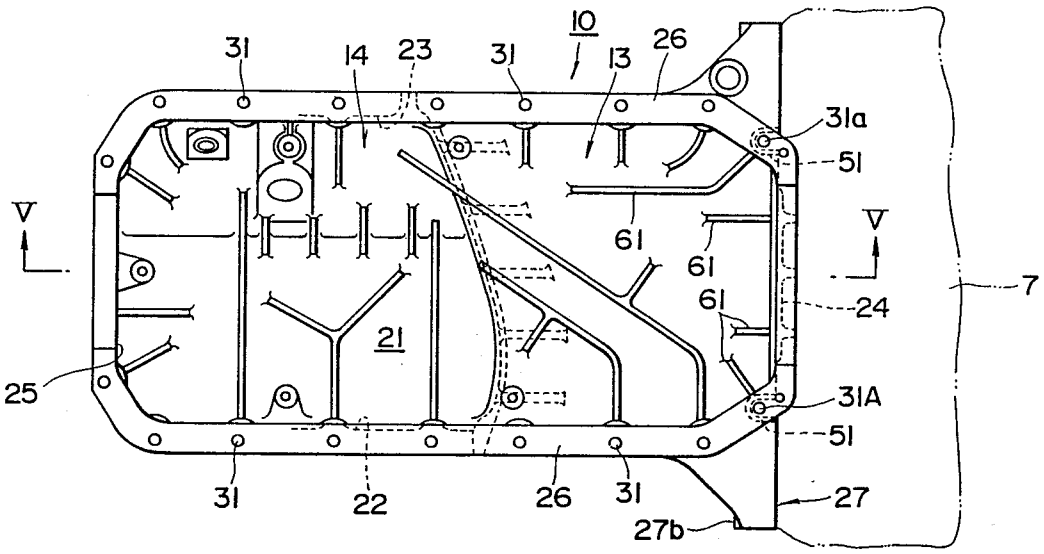
FIG. 4 is a top plan view of the oil pan of FIG. 3.
Figure 5:
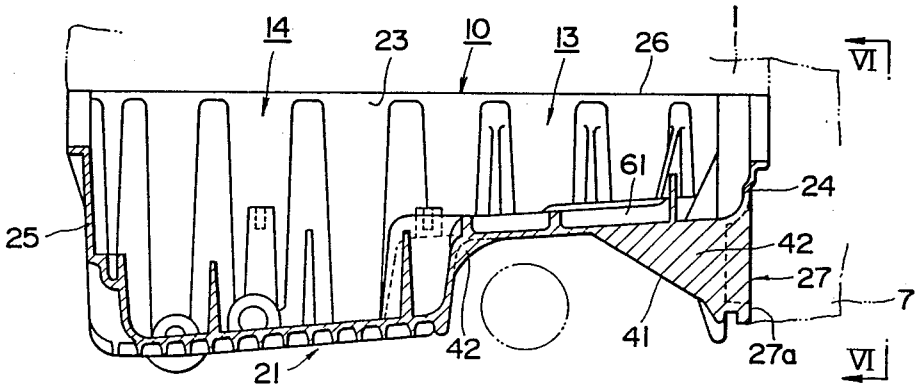
FIG. 5 is a cross sectional view taken along a line V—V of FIG. 3.

Referring now to FIGS. 3 through 5, shown therein is an oil pan 10 for a vehicle engine according to the present invention. As shown, the oil pan 10 is cast to have a stepped bottom wall 21 surrounded by side walls 22 and 23 and front and rear walls 24 and 25. The stepped bottom wall 21 forms in the oil pan 10 a shallow bottom oil pan section 13 and a deepened bottom oil pan section 14. Along top edges of the side walls 22 and 23 of the oil pan 10 there are formed laterally extending side fitting flanges 26 through which the oil pan 10 is attached or bolted to a cylinder block 1 of a vehicle engine such as shown in FIG. 1. In each side fitting flange 26, there is formed several bolt holes 31 at regular intervals through which screw caps or bolts 33 are fastened to the cylinder block 1 in order to tightly attach the oil pan 10 to the bottom of the cylinder block 1.

Figure 6:
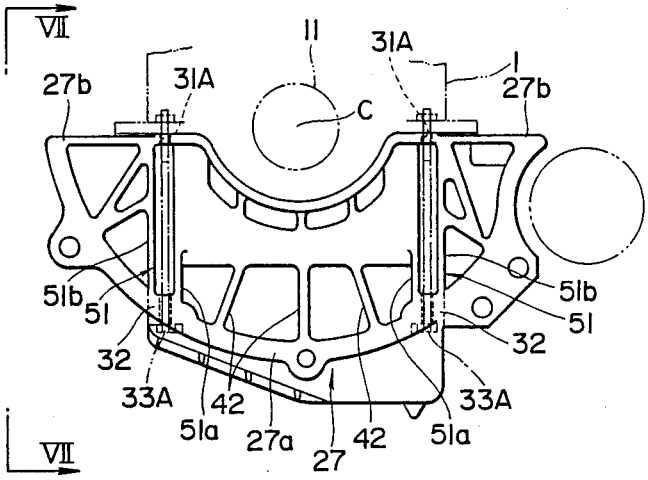
FIG. 6 is a view in the direction of the arrows of line VI—VI of FIG. 5.
Figure 7:
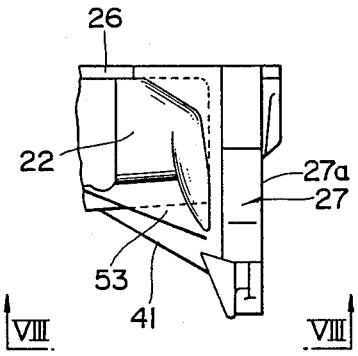
FIG. 7 is a view in the direction of the arrows of line VII—VII of FIG. 6.
Figure 8:
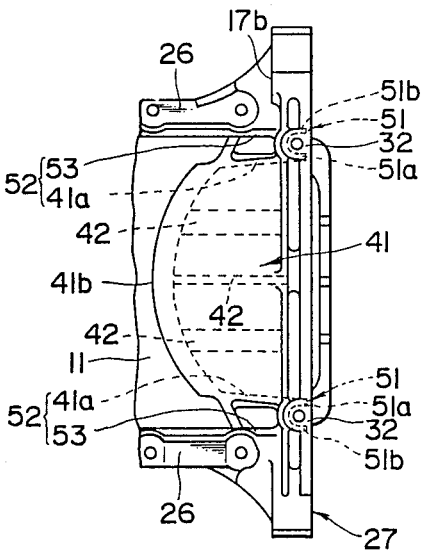
FIG. 8 is a view in the direction of the arrows of line VIII—VIII of FIG. 7.

Formed around the front wall 24 adjacent to the shallow bottom oil pan section 13 is a substantially semi-circular fitting flange 27 formed integrally with the front wall 24 for attaching a transmission case 7 to the oil pan 10 with bolts 33. As is best seen in FIGS. 3 and 6, the fitting flange 27 comprises a semi-circular flange section 27*a* and horizontal flange sections 27*b* laterally extending out of the side walls 22 and 23. The outermost portions of the semi-circular fitting flange 27 and the side walls 22 and 23 are connected to each other by means of side ribs 60. This semi-circular flange section 27*a* has its center substantially on the center line C of an output shaft 11 such as a crankshaft (see FIG. 6) of the vehicle engine. As is shown in FIG. 3 through 8, the oil pan 10 is formed with a curved reinforcing wall 41 between the back of the semi-circular flange section 27*a* and the intermediate section of the shallow bottom oil pan section 1 3, and a plurality of connecting ribs 42 integrally connecting the the stepped bottom wall 21 of the oil pan 10 and the curved reinforcing wall 41. The curved reinforcing wall 41 has an arcuate rear edge 41*b* (see FIG. 8) through which the curved reinforcing wall 41 is attached to the bottom of the shallow bottom oil pan section 13 of the oil pan. Each connecting rib 42 is shaped in the form of a triangle. These connecting ribs 42 extend radially substantially from the center C of the output shaft 11 of the vehicle engine.

A pair of bolt holes 31 facing to the semi-circular fitting flange 27 (which are designated hereinafter by a reference numeral 31A for the purpose of discrimination) are formed to receive long shanked bolts 33A in order to fasten the oil pan 10 to the cylinder block 1 through the semi-circular flange section 27*a*, from the bottom. For receiving the long shanked bolts 33A, the semi-circular flange section 27*a* is provided with bosses 32 spaced apart from and aligned with the bolt holes 31A, respectively, each boss 32 forming therein a through hole for the bolt 33A. Through the bosses 32 and the bolt holes 31A the long shanked bolts 33A are inserted to fasten the semi-circular fitting flange 27 to the front part of the engine block 1. It is noted that, when the bosses 32 are spaced apart from the top of the semi-circular fitting flange 27 which is fitted to the bottom of the cylinder block 1, it is sometimes hard to make the semi-circular fitting flange 27 and the front part of the engine block 1 fastened rigidly because the semi-circular fitting flange 27 is apt to be deformed by the fastening force of the bolt 33.

For the purpose of preventing an unexpected deformation of the semi-circular fitting flange 27 to which the transmission case 6 is attached, there are formed in the semi-circular fitting flange 27 first reinforcing ribs 51 each comprising inner and outer walls 51*a* and 51*b* vertically extending between the side fitting flange 26 and the semi-circular flange section 27*a* to surround at least a half of the circumference of each boss 32. On the back side of the semi-circular fitting flange 27, there are formed double-walled reinforcing members 52 of which reinforcing ribs 53 connect the semi-circular fitting flange 27 and shallow bottom oil pan section 13, and desirably the front wall 14*a* of the deepened bottom oil pan section 14 to each other, and extend substantially in a direction in which the outer wall 51*a* of the first reinforcing rib 51 extends. The curved reinforcing wall 41 is shaped in such a way that its opposite sides 41*a* extend in a direction in which the inner wall 51*a* of the first reinforcing rib 51 extends. By the reinforcing ribs 53 and the side portions 41*a* of the curved reinforcing wall 41, the double-walled second reinforcing ribs 52 are formed. The double-walled second reinforcing member 52 is formed so as to place the center line of the bolt hole of the boss 32 therebetween. As apparent from the above, the first and second reinforcing ribs 51 and 52 are correspondingly located at the same position but on the opposite sides relative to the semi-circular fitting flange 27.

For increasingly improving the constructional rigidity of the oil pan 10, in particular the shallow bottom oil pan section 13 to which the transmission is attached, it is preferable to provide, inside the oil pan ribs 61, connecting the front wall and the shallow bottom.

The provision of the first and second ribs 51 and 52 located on the opposite sides of the semi-circular fitting flange 27 and facing to the bosses 32 improves the constructional strength of the bosses 32 integral with the oil pan 10. As a result, the semi-circular fitting flange 27 including the bosses 32 becomes more hard to be deformed due to the fastening force of the bolts 33 and/or vibrations exerted thereon from the transmission case 7 and, thereby, the oil pan 10 cam be tightly and rigidly fastened to the engine block 1 with the bolts 33 through the bosses 32 improved in rigidity. In addition to the improvement of constructional strength of the bosses 32, the provision of the first and second reinforcing ribs 51 and 52 increasingly improves the constructional strength of the semi-circular fitting flange 27, preventing the oil pan 10 from being deformed due to vibrations of the transmission case.

Although the present invention has been fully described by way of example thereof with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. An oil pan for use with a vehicle engine comprising:
   - a stepped bottom wall surrounded by side walls and front and rear walls,
   - a fitting flange defining an outer side an inner side formed integrally with said front wall to which a transmission case is to be attached;
   - at least two bosses defining through holes attached to said fitting flanges for receiving bolts to tighten said oil pan to a cylinder block of a vehicle engine;
   - first reinforcing ribs formed on an outer side of said fitting flange, one individual to each boss, each of said ribs extending in a direction along the center line of the hole of said boss; and
   - second reinforcing ribs formed on an inner side of said fitting flange and extending correspondingly to said first reinforcing ribs.

2. An oil pan as defined in claim 1, wherein said fitting flange is semi-circular in form having its center intended to lie substantially at the center line of said vehicle engine output shaft.

3. An oil pan as defined in claim 1, wherein said first reinforcing rib surrounds at least half of the circumference of a bolt to be received in said boss.

4. An oil pan as defined in claim 1, wherein said second reinforcing rib is double-walled with the center line of the hole of said boss positioned therebetween.

5. An oil pan as defined in claim 1, wherein said fitting flange comprises a semi-circular section and radially extending top flange sections for being fitted to a bottom of said vehicle engine cylinder block and said first rib extends between said semi-circular section and each said top flange section.

6. An oil pan as defined in claim 2, further comprising third reinforcing ribs each connecting together at least said bottom wall and said semi-circular fitting flange.

7. An oil pan as defined in claim 2, wherein said semi-circular fitting flange extends beyond said side walls and further comprises third reinforcing ribs extending between said side walls and the periphery of said semi-circular fitting flange.

8. An oil pan as defined in claim 6, wherein each said third reinforcing rib, when said oil pan is attached with a vehicle engine extends substantially radially from said center line of said vehicle engine output shaft.

9. An oil pan as defined in claim 1, wherein said stepped bottom wall forms a shallow bottom section adjacent to said fitting flange and a deepened bottom section.

10. An oil pan as defined in claim 9, wherein each said second rib extends between an outer surface of said shallow bottom section and said fitting flange.

11. An oil pan as defined in claim 10, wherein each said second rib is connected to said deepened bottom section.

12. An oil pan as defined in claim 9, further comprising additional reinforcing ribs on the inside of said shallow bottom section extending from said front wall to said shallow bottom.

13. An oil pan to be attached to the bottom of a vehicle engine with bolts comprising:

a stepped bottom wall surrounded by side walls and front and rear walls for forming a shallow bottom section and a deepened bottom section in said oil pan;

a fitting flange integrally formed with said front wall to which a transmission case is to be attached;

bosses defining through holes for receiving bolts with which said oil pan is tightened to a vehicle engine; and a plurality of ribs provided at least one individually to each of said bosses connecting said fitting flange and said shallow bottom section and extending in parallel with the center line of the hole of said boss.

14. An oil pan as defined in claim 13, wherein each said rib is shaped in the form of a triangle.

15. An oil pan as defined in claim 13 wherein said plurality of ribs are different in size with each larger rib being more centrally disposed.

16. An oil pan as defined in claim 15, wherein said plurality of ribs are arranged symmetrically and are connected to a curved reinforcing wall extending between said fitting flange and said shallow bottom section of said stepped bottom wall.

17. An oil pan as defined in claim 16, wherein said curved reinforcing wall has an arcuate joint where it is connected with said shallow bottom section of said stepped bottom wall.

18. An oil pan as defined in claim 13, wherein each of said plurality of ribs is connected to said deepened bottom section.

* * * * *